United States Patent [19]

Suzuki

[11] Patent Number: 4,747,088

[45] Date of Patent: May 24, 1988

[54] TABLE CLOCK

[75] Inventor: Motoyuki Suzuki, Tokyo, Japan

[73] Assignee: Seikosha Co., Ltd., Tokyo, Japan

[21] Appl. No.: 890,757

[22] Filed: Jul. 25, 1986

[30] Foreign Application Priority Data

Jul. 26, 1985 [JP] Japan ..... 60-114554[U]

[51] Int. Cl.[4] ..... G04B 37/00

[52] U.S. Cl. ..... 368/316

[58] Field of Search ..... 368/316, 317

[56] References Cited

U.S. PATENT DOCUMENTS 1,257,159 2/1918 Wachter ..... 368/316

FOREIGN PATENT DOCUMENTS 534088 3/1922 France ..... 368/316

423469 2/1935 United Kingdom ..... 368/316

*Primary Examiner*—Bernard Roskoski

*Attorney, Agent, or Firm*—Bruce L. Adams; Van C. Wilks

[57] ABSTRACT

A table clock particularly adapted to be a portable clock for use, for example, as a travel clock. A stand member is affixed and supported at the top of the clock in a rotatable manner. The stand member can be rotated in any direction around the clock to provide a desired adjustable angle of inclination of the clock.

4 Claims, 2 Drawing Sheets

TABLE CLOCK

BACKGROUND OF THE INVENTION

The present device relates to a table clock and more particularly to a portable clock for use, for example, in travelling.

In some conventional portable clocks for use in travelling, back covers hinged at the top of the clocks functions for standing the clocks. Other clocks are provided with front covers which can be turned more than 270° for standing the clocks. Some other clocks are provided with special cases which support or stand the clocks.

Such conventional clocks are complex in structure and result in high cost. In clocks provided with the special cases, the whole thickness of the clocks increases. To provide clocks the standing angle of which can be adjustable, complex and high manufacturing accuracy is required, reflecting high cost.

One object of the present device is to provide a table clock which is simple in structure and thin in overall thickness.

In the present device, a stand member is affixed supported at its one end to the top of a clock in a rotatable turnable manner by means of an ornamental member, so that the stand member may be turned or rotated in any direction around the clock. The angle of inclination of the clock also can be adjusted by turning the stand member and thereby changing the inclination angle.

DETAILED DESCRIPTION OF THE INVENTION

Figure 1:
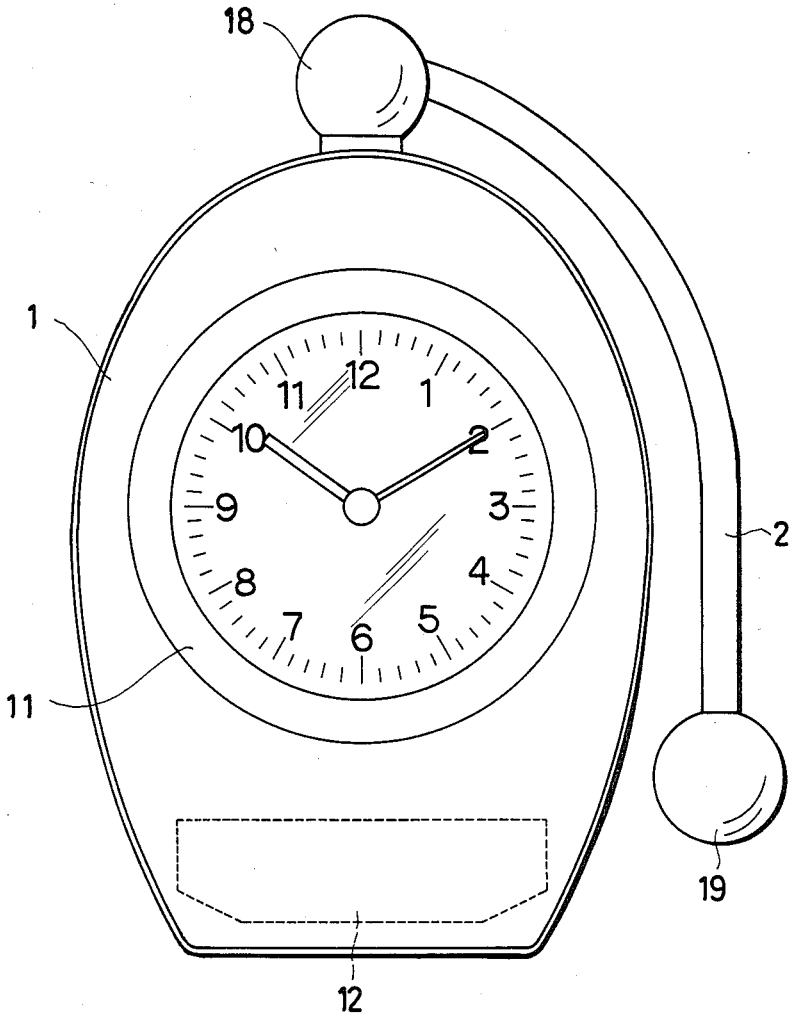
FIG. 1 is a elevational view.

Referring to the drawings, an embodiment of the present device will be explained hereunder.

Figure 2:
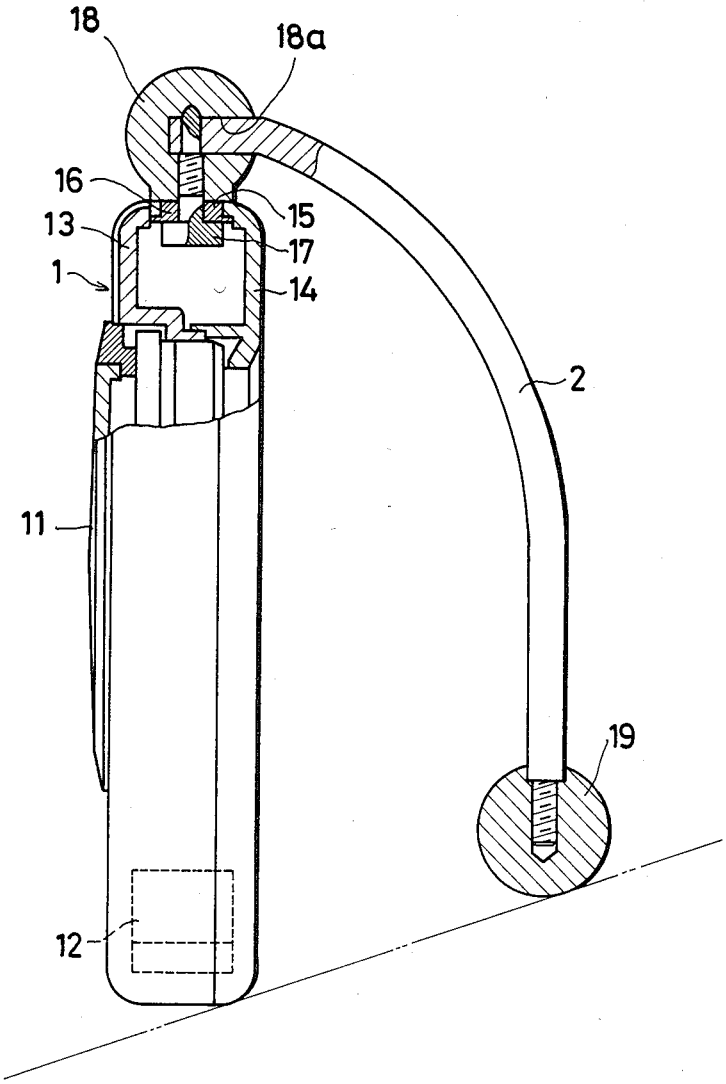
FIG. 2 is a side view partly broken away.

In FIG. 1 the clock 1 is elliptical in shape giving an image of a cosmetic bottle or the like. The time indicating portion 11 is provided at the central portion or face of the front side of the clock. A weight mass or counterweight 12 is provided in the bottom portion of the clock so the clock can stand in a stable manner. A stand member 2 is secured at its upper end to the top portion of the clock 1 in a turnable or pivotal or rotatable manner. The means for securing the stand member 2 to the clock 1 is shown in FIG. 2 and is described as follows.

A hole 15 is formed at the top of the clock 1 by a front case 13 and a back case 14. A washer 16 is forced into the hole 15. A screw 17 penetrates upwards through the washer to fasten an ornamental member 18 which is ball-shaped in this embodiment. The ornamental member 18 is provided with a hole 18*a* into which the upper end portion of the stand member 2 is inserted. The stand member 2, in turn, is provided with a hole (unnumbered, see FIG. 2) at its upper end portion through which the screw 17 penetrates. Thus the stand member 2 is turnable in any direction around the clock and is secured to the clock in a desired location by tightening the screw 17. The stand member 2 is curved in shape generally along the shape of the side of clock 1 (see FIG. 1). The stand member 2 is provided with an ornamental ball 19 at its lower end portion which rests upon a support surface.

The angle of inclination of the clock 1 is adjustable with ease by turning and changing the angle of the stand member 2.

According to the present device as described above, the structure is simple and effective for decreasing cost. Since it is not necessary to provide a case for standing, the thickness of the clock can be decreased. The adjustment of the angle of inclination of the clock can be performed with ease by rotating stand member 2. The design is so unique that the clock may function as an interior decoration as well.

What is claimed is:

1. A table clock comprising: a clock case having front and back case sections; and means for adjusting the angle of inclination at which said clock case rests upon a support surface, said means comprising rotatable stand means mounted for rotation at a top end portion of said clock case and rotatable into any of a number of selected directions around the clock, said stand means being configured in the shape of a side of the clock case so as to support the clock case at any of a number of desired angles of inclination relative to the support surface in response to rotation of said stand means about said clock case, means defining a hole in the top end portion of the clock case, a washer secured in the hole, a screw member extending through the washer, an ornamental member connected to the screw member and mounted to undergo turning movement relative to the clock case, one end of said stand means being connected to the ornamental member to undergo turning movement therewith, and an ornamental ball connected at the other end of said stand means for resting on the support surface.

2. A table clock according to claim 1; further including a counterweight disposed in a bottom portion of said clock case, said counterweight giving stability to the clock when the clock is supported at a desired angle of inclination.

3. A table clock according to claim 1; in which the ornamental member is provided with intersecting holes, said stand means being inserted in one of said holes and said screw member being inserted into the other of said holes, said screw member intersecting and penetrating said stand means to secure said stand means and said ornamental member to said clock case.

4. A relatively thin table clock comprising a top and a bottom, a counterweight in the bottom of said clock, a turnable ornamental member affixed to the top of said clock and turnable about an axis formed by a screw which extends upwardly through a washer mounted between a front case and a back case of said clock, said ornamental member having at least two holes therein, one of said holes receiving said screw and another of said holes receiving a stand member, said screw intersecting and securing said stand member to said ornamental member, said stand member being curved in a shape generally the shape of a side of said clock, said stand member being turnable through said ornamental member into any direction around the clock, the shape of the stand member and selection of a particular turnable direction providing any of a number of desired adjustable support angles for supporting said clock relative to a support surface.

* * * * *